US005388547A

United States Patent [19]

Lehr et al.

[11] Patent Number: 5,388,547

[45] Date of Patent: Feb. 14, 1995

[54] FISH SCORE CARD

[76] Inventors: Randy L. Lehr; Jean J. Hulstine, both of 600 E. Willow St., Highspire, Pa. 17034

[21] Appl. No.: 23,632

[22] Filed: Feb. 26, 1993

[51] Int. Cl.[6] ..... A63F 1/18

[52] U.S. Cl. ..... 116/222; 43/1; 116/325; 235/90; 273/DIG. 26

[58] Field of Search ..... 116/222, 306, 325, 326; 235/90; 273/DIG. 26; 43/1

[56] References Cited

U.S. PATENT DOCUMENTS 2,063,612 12/1936 Marshall et al. ..... 116/222

FOREIGN PATENT DOCUMENTS 103798 2/1917 United Kingdom ..... 116/222

749961 6/1956 United Kingdom ..... 116/222

*Primary Examiner*—William A. Cuchlinski, Jr.

*Assistant Examiner*—Willie Morris Worth

[57] ABSTRACT

A fish score card for counting the number of fish caught during a fishing trip is disclosed. The score card includes a column for each fisherman on the trip and a row for each possible type of fish caught. Each time a fish is caught the fisherman places a peg in the appropriate hole of the appropriate row and column of the scorecard. In an alternatively preferred embodiment, the fish score card may be attached to a combination length gauge and scale. The length gauge is for measuring the length of the fish and the scale is for weighing the fish.

5 Claims, 4 Drawing Sheets

FIG 1
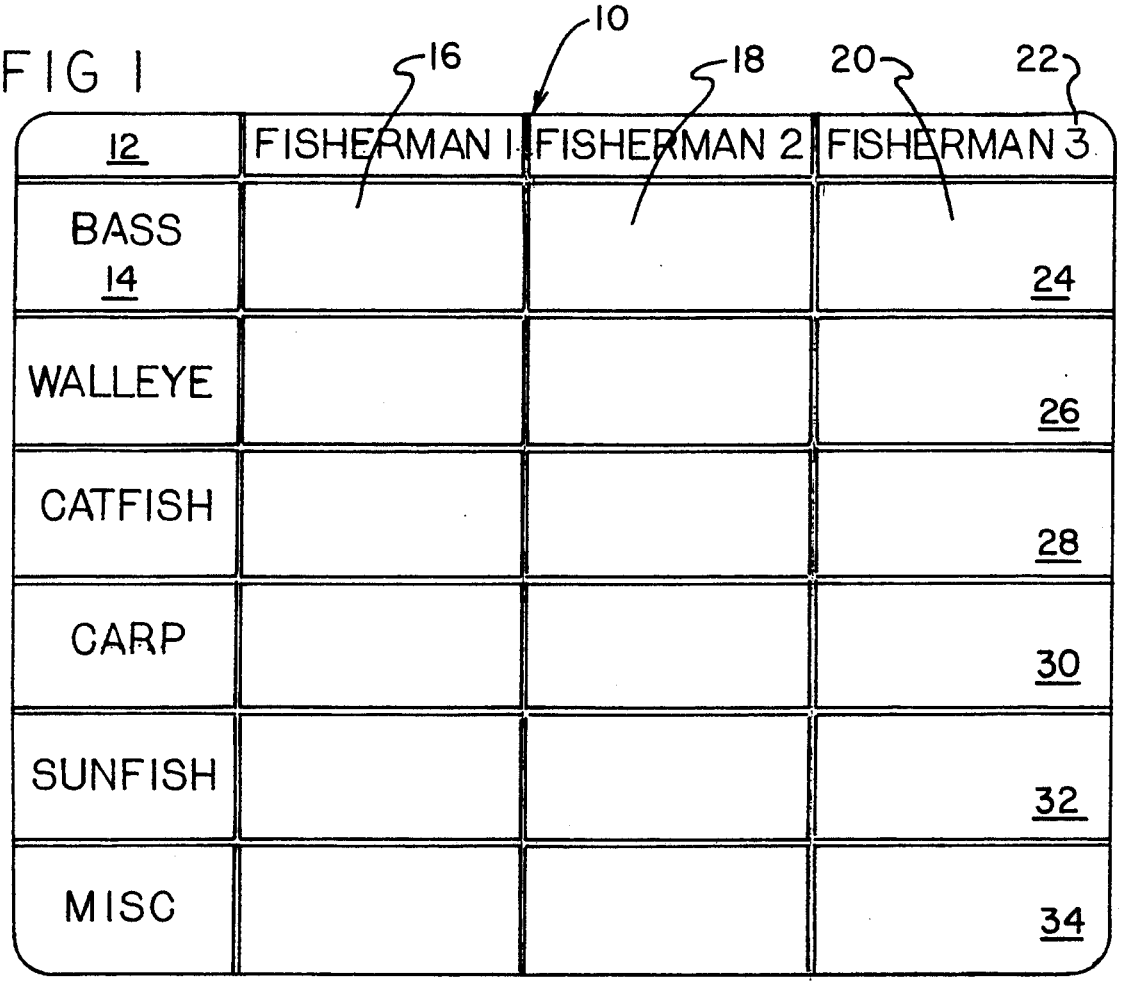
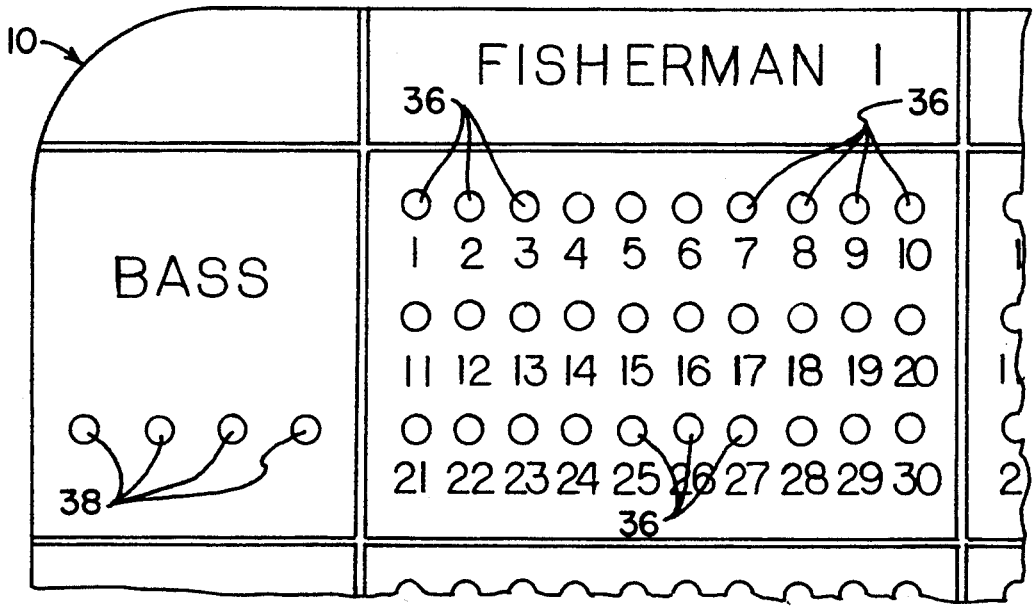
FIG 2

FISH SCORE CARD

BACKGROUND OF THE INVENTION

1. Field of the Invention

The present invention relates generally to fishing, and more particularly, to accurately counting the number of fish caught.

2. Description of the Prior Art

Devices for counting fish during a fishing trip are well known. For example, in U.S. Pat. No. 3,883,161, dated May 13, 1975, there is disclosed a combined booklet and scorecard wherein the top portion of the booklet is a grid and the lower portion being pages for the booklet. Score is kept by writing on the grid. U.S. Pat. No. D-289,528, dated Apr. 28, 1987, discloses an ornamented grid for a calculator. U.S. Pat. No. 3,554,159, dated Jan. 12, 1971, discloses a game scorecard representative of a playing field having adjustable sliding elements. U.S. Pat. No. 5,013,069, dated May 7, 1991, discloses a golf scorecard. Finally, U.S. Pat. No. 3,921,981, dated Nov. 25, 1975, discloses a game having a game board with a picture of a lake and a continuous series of representations indicating the next action a player is to take. A need exists, therefore, for a device to keep score of how many fish and what types of fish are caught on a fishing trip. Normally, people use a paper and pen to keep score but the paper constantly blows away in the wind or gets wet, or the pen fails to work. This adds to the uncertainty of what the members of the trip caught and how many. With the present invention there is no need for a paper or pen. When a fish is caught a peg is placed in the appropriate box on a scorecard which is fastened in place and does not encounter the problem of the ink fading or running all over the scores.

The foregoing advantages are accomplished by the unique fish score card of the present invention as will be made apparent from the following description thereof. Other advantages of the present invention over the prior art also will be rendered evident.

SUMMARY OF THE INVENTION

To achieve the foregoing and other advantages, the present invention, briefly described, provides a fish score card for counting the number of fish caught during a fishing trip. The score card includes a column for each fisherman on the trip and a row for each possible type of fish caught. Each time a fish is caught the fisherman places a peg in the appropriate hole of the appropriate row and column of the scorecard. In an alternatively preferred embodiment, the fish scorecard is attached to a combination length gauge and scale. The length gauge is for measuring the length of the fish and the scale is for weighing the fish.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining a preferred embodiment of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved fish score card which has all of the advantages of the prior art and none of the disadvantages.

It is another object of the present invention to provide a new an improved fish score card which may be easily and efficiently manufactured and marketed.

It is a further objective of the present invention to provide a new and improved fish score card which is of durable and reliable construction.

An even further object of the present invention is to provide a new and improved fish score card which is susceptible of a low cost of manufacture with regard to both materials and labor, and which accordingly is then susceptible of low prices of sale to the consuming public, thereby making such fish score card available to the buying public.

Still yet a further object of the present invention is to provide a new and improved fish score card which will not blow away on a windy day.

It is still a further object of the present invention to provide a new and improved fish score card which would not be detrimentally affected by water.

Still a further object of the present invention is to provide a new and improved fish score card which will accurately keep track of the number and types of fish caught.

An even further object of the present invention is to provide a new and improved fish score card including means for weighing and measuring the length of each fish caught.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein:

FIG. 1 is a view showing the front of the preferred embodiment of the fish score card of the present invention.

FIG. 2 is a more precise view showing the front of the fish score card of the present invention.

DESCRIPTION OF THE PREFERRED EMBODIMENT

Figure 3:
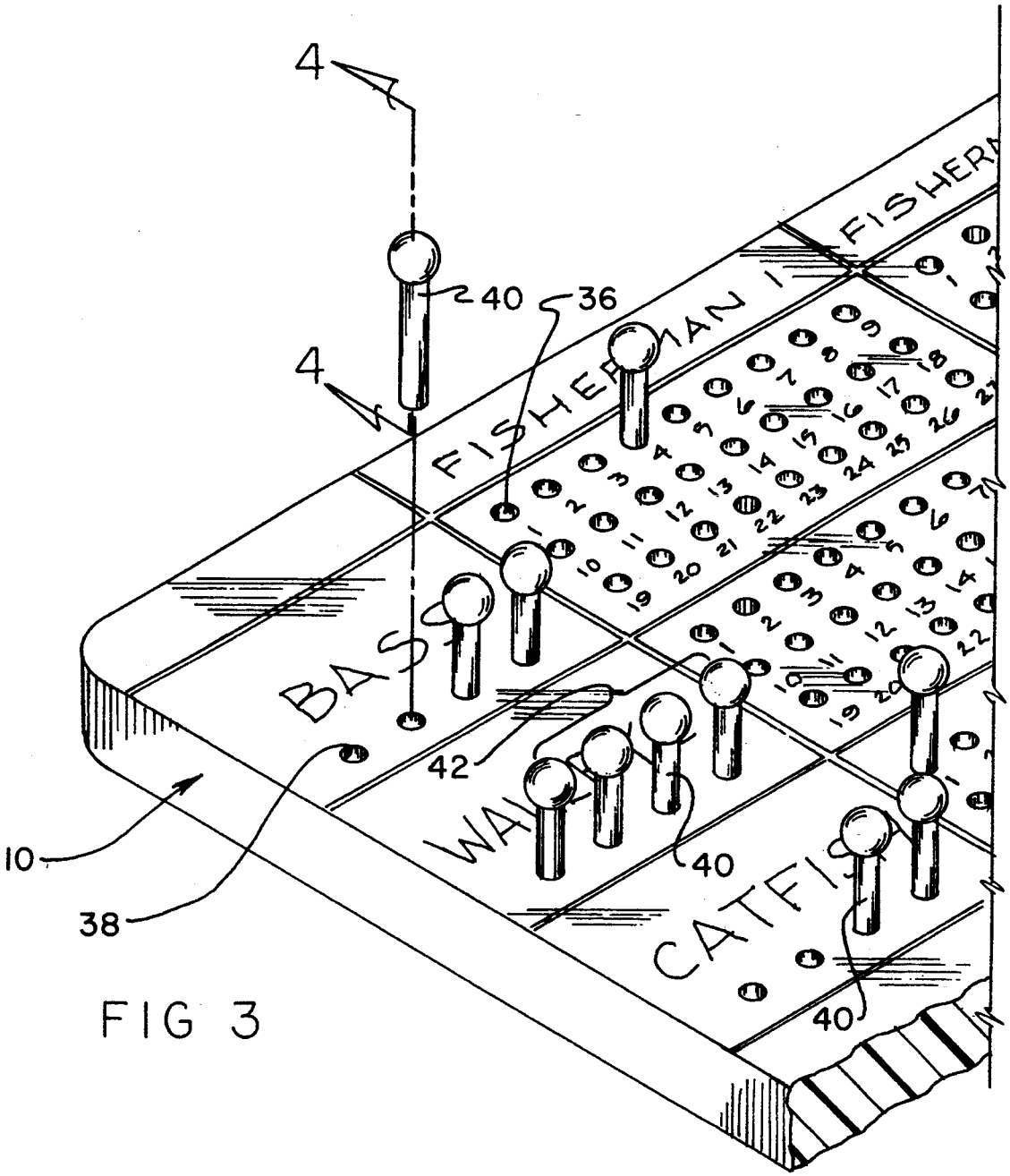
FIG. 3 is a perspective view of the invention shown in FIGS. 1 and 2 including scoring pegs.
Figure 4:
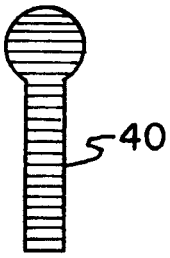
FIG. 4 is a cross-sectional view of a scoring peg lined for the color blue.
Figure 5:
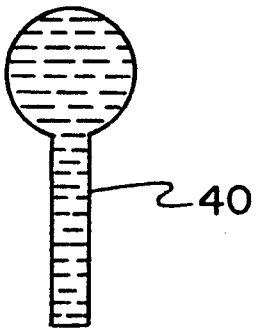
FIG. 5 is a cross-sectional view of a scoring peg lined for the color gray.
Figure 8:
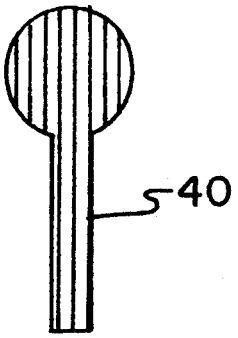
FIG. 8 is a cross-sectional view of a scoring peg lined for the color red.
Figure 6:
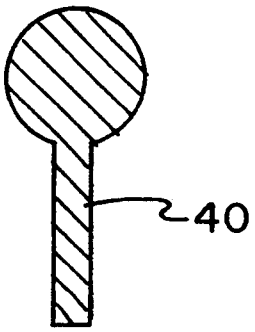
FIG. 6 is a cross-sectional view of a scoring peg lined for the color green.
Figure 9:
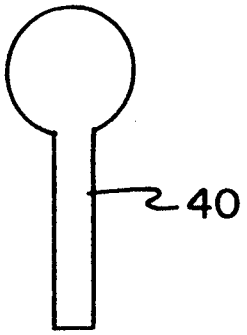
FIG. 9 is a cross-sectional view of a scoring peg lined for the color white
Figure 7:
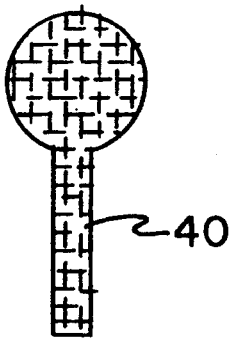
FIG. 7 is a cross-sectional view of a scoring peg lined for the color yellow.

With reference now to the drawings, a new and improved fish score card embodying the principles and concepts of the present invention will be described.

Turning initially to FIGS. 1 to 9 there is shown an exemplary embodiment of the fish score card, designated generally by reference numeral 10, of the present invention.

The score card has a front side 12. The front side is divided into at least four columns, 14, 16, 18 and 20. The front side is further divided into at least seven rows, 22, 24, 26, 28, 30, 32 and 34. The first column, 14, is labeled with names of different types of fish. The second column, 16, is labeled "Fisherman 1". The third column, 18, is labeled "Fisherman 2". The fourth column is labeled "Fisherman 3" and so on. The columns are used to separate each person fishing. The first row, 22, has the labels dividing each fisherman. The second through seventh rows, 24 to 34, are each labeled with the name of a different type of fish. For example, row two, 24, may be labeled "Bass", row three, 26, may be labeled "Walleye", row four, 28, labeled "catfish", row five, 30, may be labeled "carp", row six, 32, may be labeled "sunfish", and row seven, 34, may be labeled "misc." indicating all other fish.

Each box below the row labeled for each fisherman and to the right of the column labeled with each different type of fish has thirty holes, 36, which are numbered from 1 to 30 substantially as shown. Each box labeled with the name of a fish has a series of holes each designated by reference numeral 38 and each corresponding to a different column labeled for a fisherman. In the particular embodiment shown there are three holes 38 one for each of Fisherman 1, Fisherman 2, and Fisherman 3, respectively, and one extra hole. Each hole in the boxes labeled with the name of a fish has a peg 40 normally received therein. The pegs in each box labeled by a particular fish have the same color representing that fish and form a set of pegs designated by reference numeral 42. Each set of pegs 42 are a different color as illustrated by FIGS. 3 to 9. Thus, for example, the four pegs 38 making set 42 in the box labeled "BASS" are of the color blue, the pegs in the box labeled "WALLEYE" are of the color gray, and so on.

The score card is ideally made of durable, thermoplastic, easy to clean material such as plexiglass, for example, whereas pegs 38 preferably are of polvinyl chloride (PVC). In the alternative embodiment of the invention, score card is made integral as the front side of a combination fish weight scale and fish length gauge designated by reference numeral 44. The rear side of scale/gage 44 has protruding therefrom a pair of spaced semi-cylindrical housing portions each designated by reference numeral 45 and each receiving a supporting rod 51 suitably mounted on a rectangular base 53. A helical spring 48 extends upwardly from each rod and engages the inside top surface of each housing portion so as to support the housings and the combination score card and scale/gage for up and down movement upon rods 51 and relative to both the rods and base 53. The scale portion 46 includes a pointer 50 suitably affixed to base 53 substantially as shown, and a gauge 52 printed longitudinally on the side of the left-most housing portion 45 calibrated to indicate the weight of a fish.

The length gauge 54 includes a first, stationary T-shaped bar 56 having a transverse vertical bar 64 at one end. A fish length gauge 58 preferably calibrated to measure in inches the length of a fish is printed or otherwise affixed along side the longer portion 65 of the T-shaped bar 56 proximal to a longitudinal slot 68 disposed therein substantially as shown. A second T-shaped bar 60 is slidably received through opening 70 of a rectangular recess communicating with slot 68 and includes a transverse vertical bar 66 at one end and a pointer 62 attached to its other end and extending through slot 68. By the foregoing arrangement, the T-shaped bar 60 may be slidably positioned within recess 70 to accommodate a caught fish between vertical bar portions 64 and 66 whereupon the length of the fish may be read via pointer 62 and gage 58 as will be apparent to the routineer.

In operation, the fish score card of the invention is used when a number of people go on a fishing trip in the following preferred manner. When an individual fisherman catches a fish, a peg 38 indicating the type of fish is removed from a corresponding set of pegs 42 in column one and moved along that row for placement in the peg hole 36 labeled 1 in the column designated for that fisherman. Should that fisherman catch a second fish of the same type, the peg is moved to the peg hole 36 labeled 2 in the stone box and so on. Should a fisherman catch more fish than is able to be recorded by one peg in a box, a second or "extra" peg 40 is used in the same box and the total represented by the first and second pegs is added together to figure a grand total.

Figure 10:
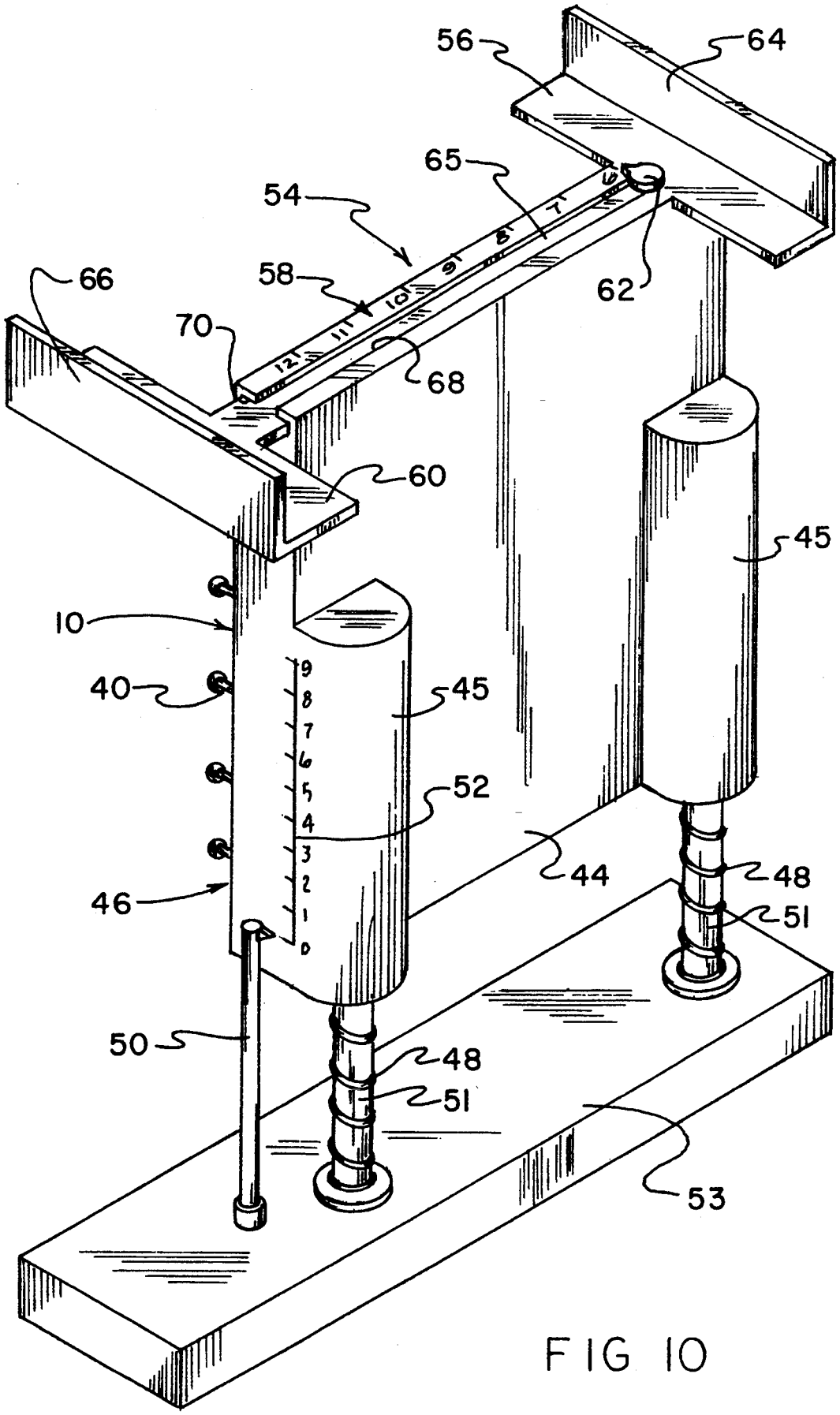
FIG. 10 is a perspective view of an alternatively preferred embodiment of the invention featuring a fish score card according to the invention in combination with a length gauge and scale.

Referring to the alternatively preferred embodiment of FIG. 10, after the catching of a fish is recorded on the score card 10, the fish may be placed between the vertical bars on both the stationary and slidable T-shaped bars. The slidable T-shaped bar is moved so the fish fits snugly between the vertical bars. The pointer points to the gauge at a position indicating the length of the fish.

When the fish is placed on the gauge the springs of the scale compress and the entire score card and scale/-gage unit will move downwardly in an amount proportional to the weight of the fish. The pointer 50 will thus indicate on gage 52 the weight of the fish.

It is apparent from the above that the present invention accomplishes all of the objectives set forth by providing a new and improved fish calculator which will remain stationary, be unaffected by wind or water and which includes a device for both weighing and measuring the fish caught.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A fish score card comprising:

a substantially flat planar member having first and second opposed side;

said first side of said planar member being divided into a plurality of vertical columns and a plurality of horizontal rows by a first plurality of vertically spaced parallel lines and a second plurality of horizontally spaced parallel lines with said first plurality of lines intersecting said second plurality of lines orthogonally on said first side of said planar member wherein said intersecting lines define said plurality of columns as comprising columns of vertically aligned boxes and wherein said intersecting lines further define said plurality of rows as comprising rows of horizontally aligned boxes on said first side of said planar member;

each box of one of said plurality of columns of vertically aligned boxes having indicia associated therewith representative of a specific type of fish, respectively, and each said box in said one column having a first series of holes each adapted to receive a peg;

wherein said boxes in other of said columns making up said plurality of columns each have therein a second series of holes each of which is adapted to receive a peg, said second series of holes being greater in number than said first series of holes, wherein said other of said columns making up said plurality of columns has indicia associated therewith to identify a different fisherman respectively; and a plurality of pegs received in said first series of holes and being adapted for selective removal and insertion in a selected one of said second series of holes to identify the number of a particular type of fish caught by each of said different fisherman, respectively.

2. The fish score card of claim 1 wherein said plurality of pegs in said first series of holes in each box in said one column defines a separate particular group of pegs for each of said boxes making up said one of said plurality of columns of vertically aligned boxes having indicia associated therewith representative of a specific type of fish, respectively, and wherein the pegs in each particular group are of the same color.

3. The fish score card of claim 2 wherein the pegs in said separate groups are of a different color respectively.

4. The fish score card of claim 1 wherein the number of holes in said first series is four and the number of holes in said second series is thirty.

5. The fish score card of claim 1 wherein said planar member is a made of a thermoplastic material.

* * * * *